United States Patent [19]

MacFarlane et al.

[11] Patent Number: 4,793,163

[45] Date of Patent: Dec. 27, 1988

[54] HASP-TYPE LATCH AND METHOD OF MAKING AND USING SAME

[75] Inventors: Walter J. MacFarlane, Kensington; Louis G. Bobrowski, Berlin, both of Conn.

[73] Assignee: The Stanley Works, New Britain, Conn.

[21] Appl. No.: 16,273

[22] Filed: Feb. 19, 1987

[51] Int. Cl.[4] ..... E05B 65/48

[52] U.S. Cl. ..... 70/2; 16/374; 29/11; 29/436; 70/5; 70/13; 292/204; 292/281

[58] Field of Search ..... 292/281, 204, DIG. 15; 70/2–13; 16/374, 376, 297, 319; 29/11, 436, 434

[56] References Cited

U.S. PATENT DOCUMENTS

| | | | |
|---|---|---|---|
| 58,091 | 9/1866 | Fox | 292/281 |
| 162,486 | 4/1875 | McConway . | |
| 404,080 | 5/1889 | Frost . | |
| 511,933 | 1/1894 | Cottier . | |
| 597,712 | 1/1898 | Eldridge . | |
| 682,657 | 9/1901 | Wirt . | |
| 879,948 | 2/1908 | Durett | 70/13 |
| 906,528 | 12/1908 | Hulbert . | |
| 943,401 | 12/1909 | Ehemann | 292/DIG. 15 X |
| 1,141,542 | 6/1915 | Hart . | |
| 1,195,493 | 8/1916 | Nedrow . | |
| 1,335,959 | 4/1920 | Flagg . | |
| 1,508,384 | 9/1924 | Drake . | |
| 1,522,998 | 1/1925 | Buerger et al. | 292/204 X |
| 1,574,348 | 2/1926 | Hager . | |
| 1,802,741 | 4/1931 | Stephens | 292/204 X |
| 1,890,912 | 12/1932 | Momm | 292/204 |
| 1,938,258 | 12/1933 | Luneburg | 292/285 |
| 1,992,734 | 2/1935 | Bittorf . | |
| 2,046,078 | 6/1936 | Marshall . | |
| 2,067,255 | 1/1937 | Bittorf . | |
| 2,267,374 | 12/1941 | Eber . | |
| 2,314,180 | 3/1943 | Thiele | 292/209 |
| 2,325,914 | 8/1943 | Moberg | 292/204 X |
| 2,428,207 | 9/1947 | Dzurinda . | |
| 2,430,311 | 11/1947 | Thiele | 292/281 |
| 2,520,742 | 8/1950 | Soref et al. . | |
| 3,416,338 | 12/1968 | Gehrie . | |
| 3,476,429 | 11/1969 | Foote . | |
| 3,527,070 | 9/1970 | Sato . | |
| 3,707,861 | 1/1973 | Lindner | 70/74 |
| 3,787,082 | 1/1974 | Foote | 292/281 |
| 3,831,989 | 8/1974 | Gurzenda | 292/DIG. 15 X |

(List continued on next page.)

FOREIGN PATENT DOCUMENTS

| | | | |
|---|---|---|---|
| 155127 | 11/1938 | Fed. Rep. of Germany | 292/268 |
| 733859 | 7/1932 | France | 292/268 |
| 735011 | 8/1932 | France | 292/268 |
| 3861 | 2/1911 | United Kingdom | 292/268 |
| 279611 | 11/1927 | United Kingdom | 292/281 |
| 311036 | 5/1929 | United Kingdom | 292/281 |
| 314408 | 6/1929 | United Kingdom | 292/281 |

OTHER PUBLICATIONS

3 Photographs of the Alliance Tool Company Hasp Structure.

*Primary Examiner*—Lloyd A. Gall

[57] ABSTRACT

A hasp-type latch includes a hasp member with a base having a base wall and a pair of upstanding side walls and a latch arm which is pivotally mounted thereon. The side walls of the pad include releasable latching elements which are engageable with the arm in its open position to hold it in that position. The staple member has a base with a top wall and a depending sidewall defining a cavity thereunder, and the top wall has an opening therethrough. A post member has a pedestal portion which extends through the opening into the cavity of the staple base, and a post portion which extends upwardly through the aperture in the arm in its closed position. The pedestal portion includes securing means in the cavity which extends outwardly beyond the opening in the top wall to prevent the post member from being pulled through that opening. Generally the post member is rotatable to locate an elongate axis so that it overlies a portion of the hinge leaf in the closed position and prevents its being pivoted upwardly. The post member may include an integrally formed lock such as combination locks and key locks to lock the post member in this latching position.

21 Claims, 8 Drawing Sheets

U.S. PATENT DOCUMENTS

| | | | |
|---|---|---|---|
| 3,845,644 | 11/1974 | Lindner | 70/74 |
| 3,942,344 | 3/1976 | Gehrie et al. | 70/70 |
| 4,079,974 | 3/1978 | Roper | 292/281 |
| 4,100,775 | 7/1978 | Bako | 70/3 |
| 4,168,616 | 9/1979 | Goldman | 70/119 |
| 4,259,856 | 4/1981 | Wingert | 70/70 |
| 4,267,716 | 5/1981 | Milles | 70/70 |
| 4,279,136 | 7/1981 | Milles | 70/71 |
| 4,290,286 | 9/1981 | Rae | 70/285 |
| 4,308,731 | 1/1982 | Remington | 70/74 |
| 4,318,287 | 3/1982 | Remington et al. | 70/71 |
| 4,324,120 | 4/1982 | Gisiger | 70/312 |
| 4,327,566 | 5/1982 | Ling | 70/312 |
| 4,341,101 | 7/1982 | Bako | 70/312 |
| 4,343,163 | 8/1982 | Scelba et al. | 70/312 |
| 4,348,878 | 9/1982 | Chang | 70/5 |
| 4,354,366 | 10/1982 | Bako | 70/312 |
| 4,355,524 | 10/1982 | Bako | 70/312 |
| 4,366,684 | 1/1983 | Bako et al. | 70/68 |
| 4,366,685 | 1/1983 | Remington | 70/70 |
| 4,366,686 | 1/1983 | Remington et al. | 70/71 |
| 4,366,687 | 1/1983 | Atkinson | 70/71 |
| 4,383,425 | 5/1983 | Orabona | 70/312 |
| 4,389,863 | 6/1983 | Bako | 70/312 |
| 4,395,892 | 8/1983 | Remington | 70/312 |
| 4,403,799 | 9/1983 | Kafka et al. | 292/285 |
| 4,420,953 | 12/1983 | Remington | 70/74 |
| 4,420,956 | 12/1983 | Li | 70/312 |
| 4,441,346 | 4/1984 | Castiglioni | 70/312 |
| 4,450,698 | 5/1984 | Scelba | 70/312 |
| 4,462,232 | 7/1984 | Yang | 70/312 |
| 4,467,628 | 8/1984 | Zampini, Jr. | 70/312 |
| 4,487,043 | 12/1984 | Milles | 70/312 |

FIG. 12
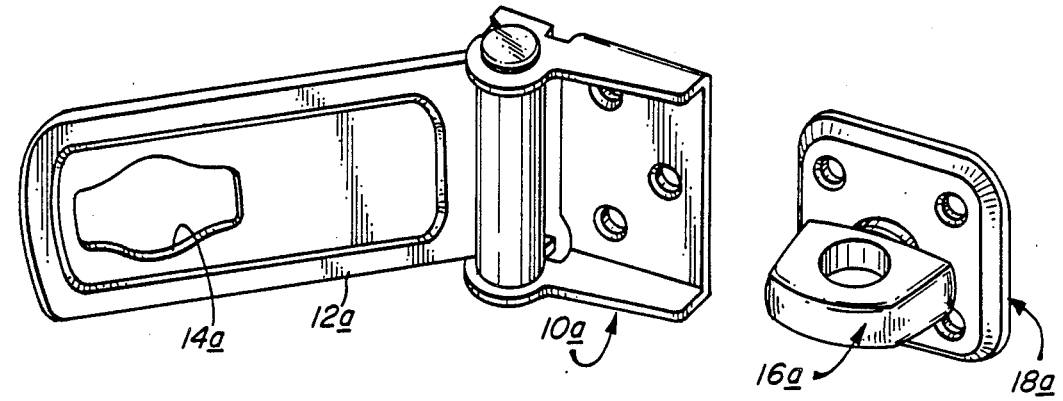
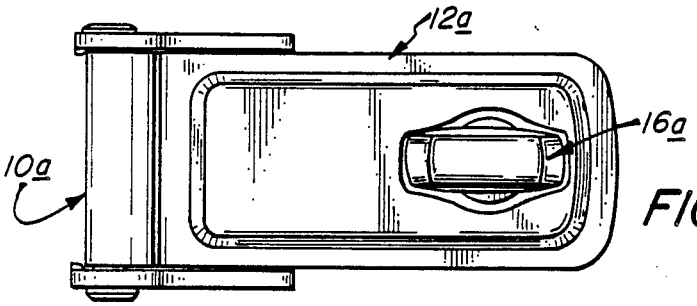
FIG. 13
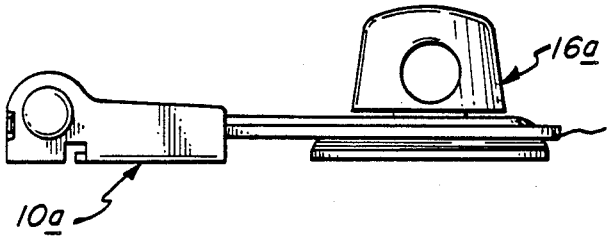
FIG. 14
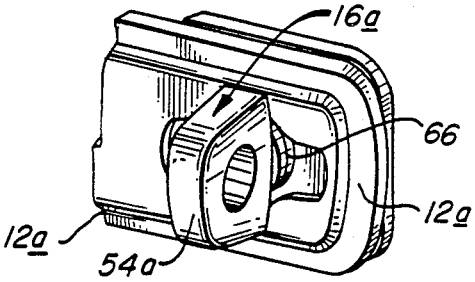
FIG. 15

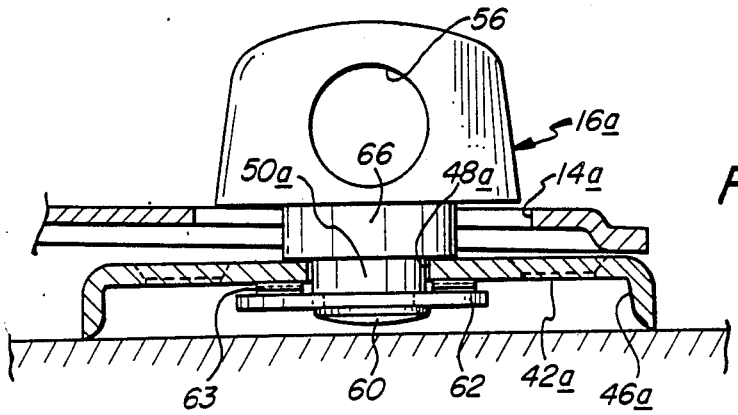
FIG. 16
FIG. 21
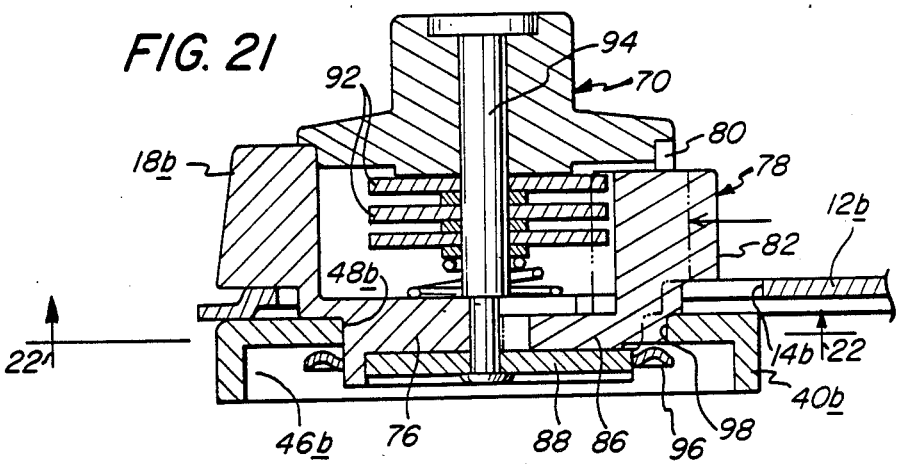
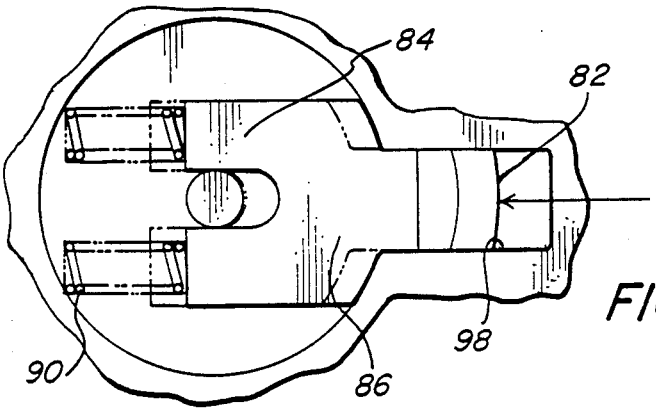
FIG. 22

FIG. 17
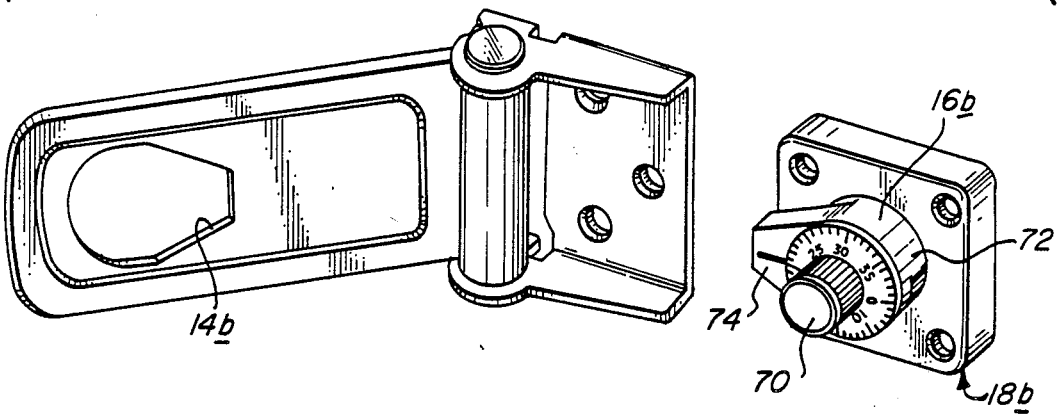
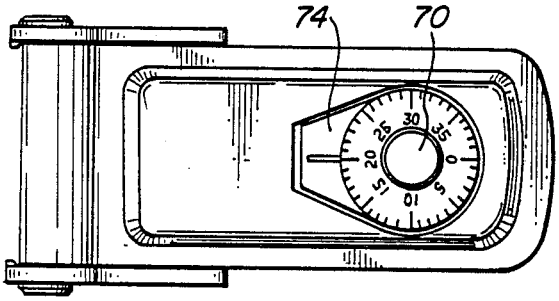
FIG. 18
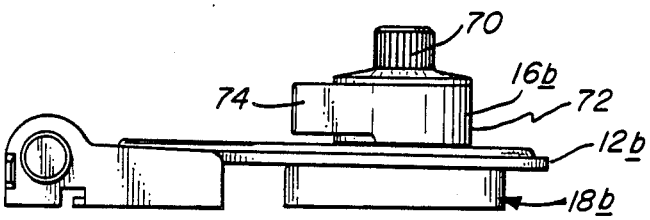
FIG. 19
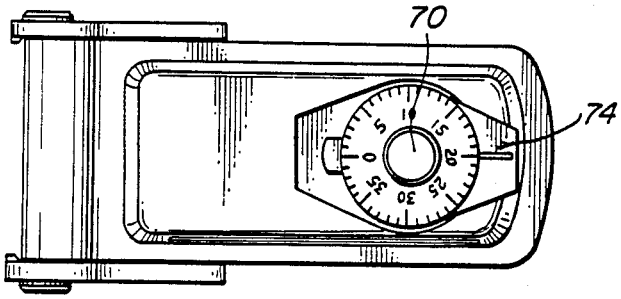
FIG. 20

FIG. 23
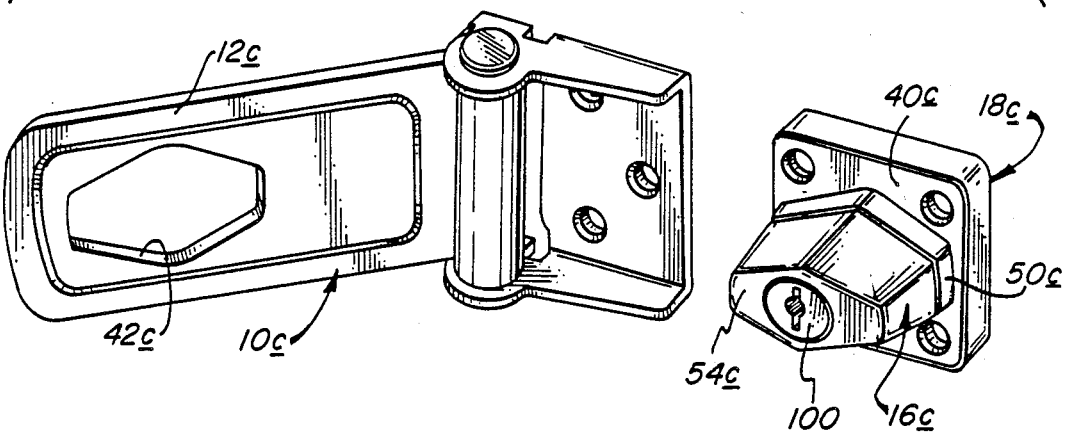
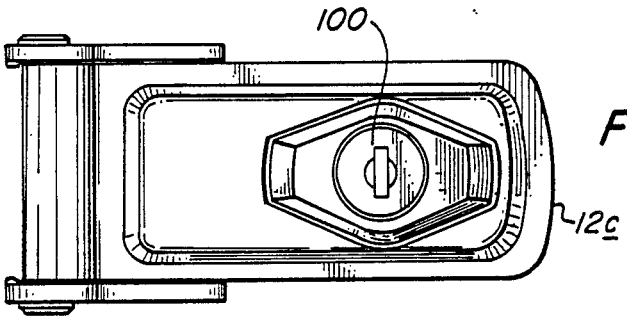
FIG. 24
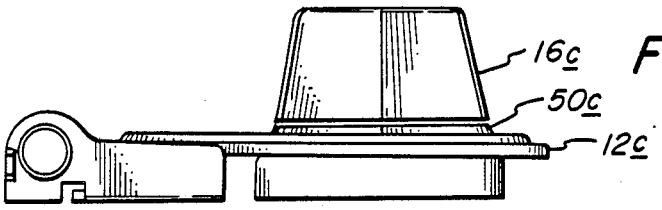
FIG. 25
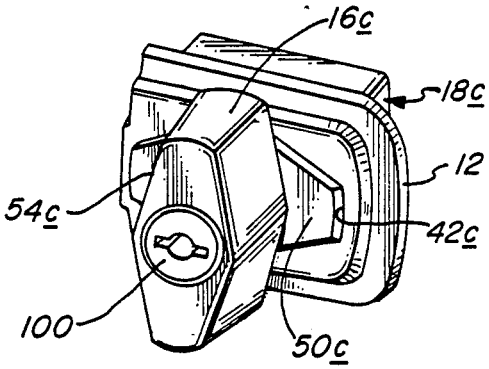
FIG. 26

HASP-TYPE LATCH AND METHOD OF MAKING AND USING SAME

BACKGROUND OF THE INVENTION

Latches of the hasp-type have been widely employed in connection with industrial doors, gates and various other structures where a relatively strong, but relatively low cost latching assembly is desired to retain a door or gate in a closed position. Frequently such hasp-type latches will include a staple with a formed wire element providing a U-shaped structure which is intended to receive the shackle of a key lock or combination lock to hold the latch arm in a position therebelow and against the staple base.

In recent years, efforts have been made to improve the appearance of such latches, and also to provide greater strength. In some instances, cast structures have been used to provide the staple member. It has also been proposed to employ staple members which would have a post that i rotatable, on the base and have a portion which overlies the latch arm in its closed position to act at least as a temporary latching mechanism to hold the latch arm in closed position.

One of the problems in using such hasp structures is that the latch arm frequently falls into the closed position and interferes with the closing of the door or the gate. It may also project beyond the free end of the door or gate so that it interferes with passage thereby or causes injury to person or property moving by it. Another problem has been the tendency for locks utilized in connection with the hasps to fall to the ground, be lost, or be stolen, while the latch is in the open position.

It is an object of the present invention to provide a novel hasp-type latch which may be readily fabricated and in which the hasp member includes means for retaining the latch arm in the open position.

It is also an object to provide such a latch in which a variety of staple members may be utilized to effect the latching of the latch arm.

Another object is to provide such a latch in which the staple member has integrally formed therein locks, such as key locks and combination locks, to minimize theft, loss and the like.

A further object is to provide a latch in which the post member is securely retained in a latching position over the latch arm in its closed position.

A still further object is to provide a novel method for fabricating latches of the type hereinbefore described.

SUMMARY OF THE INVENTION

It has now been found that the foregoing and related objects may be readily attained in a hasp-type latch which includes a hasp member having a pad with a base wall and a pair of upstanding walls extending along its side margins. Disposed between the upstanding walls is an elongated leaf having one end portion terminating in a generally cylindrical barrel portion and having an aperture therethrough adjacent its other end. Hinge pin means seated in the upstanding walls adjacent their one end and extending into the barrel portion pivotally mount the leaf on the pad for movement from a locking position wherein its opposite end portion extends beyond the margins of the pad spaced from the hinge pin and an open position in which it extends in the opposite direction. The pad also has means thereon releasably engageable with the leaf in its open position to hold it in such position.

The latch also includes a staple member having a base with a top wall and a depending sidewall defining a cavity thereunder, and the top wall has an opening therethrough. A post member has a pedestal portion which extends through the opening into the cavity and a post portion which extends above the top wall and through the aperture in the leaf in the closed position thereof. Securing means on the pedestal portion in the cavity extends beyond the opening to prevent the pedestal portion from being pulled through the opening in the top wall.

In the more desirable embodiments, the portion is rotatable on the base, and the releasably engageable means on the pad comprises detents frictionally engaging the leaf. These detents are provided on, and the hinge pin means is seated in, enlarged portions of the sidewall adjacent the one end of the pad. Preferably, the wall of the pad is truncated at a point spaced from its one end.

To provide a latching action in the preferred embodiments, the aperture in the leaf is elongated in the longitudinal dimension of the leaf, and the post portion is rotatable on the base and is elongated. The post portion is dimensioned and configured to extend through the aperture in the leaf in a first position wherein its elongate axis extends parallel to that of the leaf and to overlie a portion of the leaf about the aperture when rotated 90° into a second position. To prevent such rotation, the pedestal portion has a section adjacent the post portion of a width which is less than the minimum dimension of the aperture in the leaf and which extends through the aperture in the closed position of the leaf.

In one embodiment, the post member includes a locking assembly with manipulatable lock means and latch means engageable with the base to prevent rotation of the post portion from its second position to the first position, and this latch means is releasable by operation of the manipulatable lock means. In one design, the manipulatable lock means is a key lock, and there is an extensible element on the post portion which is engageable in a recess to effect the prevention of rotation.

In embodiments which do not incorporate an integral lock, the post portion has a passage extending therethrough to receive the shackle of a separate lock or the like.

In one embodiment, the post member is integrally formed with a pedestal portion having a section within the cavity of the base which is of greater dimension than the opening and a post portion which projects outwardly therefrom. This enlarged section of the pedestal portion may be provided by a locking element engaged on its body. The post member may additionally include resiliently compressible means disposed between the locking element and the adjacent surface of the top wall of the base to provide resistance to rotation of the post portion.

The post member is comprised of a locking assembly including manipulatable lock means and latch means actuatable thereby and engageable with the base to prevent rotation of the post member. This then prevents pivoting of the leaf outwardly from the post member.

This latch means may comprise a dog movable to engage in a recess to prevent rotation of the post portion, and this dog is movable upon operation of the lock means. Conveniently, this may utilize a combination lock.

In the method for making a hasp-type latch, a sheet metal workpiece is formed to provide a generally U-shaped pad with a base wall adapted to be mounted on a support surface and a pair of upstanding side walls having aligned apertures adjacent one end thereof. Releasably engageable means is provided on the side walls adjacent the edges of the one end and spaced outwardly from the base wall. An elongated sheet metal workpiece is formed into a latch arm with a rolled barrel of generally cylindrical configuration at one end and an aperture extending therethrough adjacent its other end. This leaf is assembled to the pad with its barrel aligned with the apertures in the sidewalls, and hinge pin means is seated in the apertures and barrel.

A sheet metal workpiece is formed to provide a rectangular box-like base with a top wall and a sidewall extending thereabout to define a cavity and to provide an opening in the top wall. Assembling to this base is a post member having a pedestal portion extending through the opening into the cavity and a post portion extending upwardly from the top wall. This post portion is dimensioned and configured to extend through the aperture in said leaf.

In the preferred method, the step of forming the sheet metal workpiece into the pad includes removing of metal from the workpiece so as to terminate the base wall adjacent the barrel. The step of providing the engageable means on the side walls of the pad comprises staking inwardly edge portions of the side walls to provide detents for frictionally engaging the edges of the leaf.

In a preferred embodiment, the post member comprises in part a combination lock with an extensible portion engageable with the base upon rotation of the post member to a latching position and movable to effect disengagement thereof upon rotation of the lock to the proper combination. In another embodiment the post member comprises in part a key lock with a projecting portion engageable with the base in a locking position thereof upon rotation of the post member and the key lock to a locking position and disengageable therefrom upon unlocking of the key lock to permit rotation of the post member to an unlatching position.

BRIEF DESCRIPTION OF THE DRAWINGS

FIG. 12 is a perspective view of another embodiment of the latch of the present invention wherein the post member is rotatable and dimensioned and configured to hold the latch arm in closed position, the latch arm being shown in the open position;

FIG. 13 is a plan view of the latch of FIG. 12 with the arm pivoted into the closed position;

FIG. 14 is a side elevational view thereof;

FIG. 15 is a fragmentary perspective view to an enlarged scale of the staple end with the post member rotated 90° to latch the latch arm;

FIG. 16 is a fragmentary sectional view of the staple end of the latch as seen in FIG. 14 drawn to an enlarged scale;

FIG. 17 is a perspective view of still another embodiment of the latch utilizing a combination lock on the staple member and with the latch arm in the open position;

FIG. 18 is a plan view thereof with the latch arm pivoted into the closed position;

FIG. 19 is, a side elevational view thereof;

FIG. 20 is a plan view of the latch with the post member rotated 180° into the latching position;

FIG. 21 is a fragmentary sectional view of the staple end in the latched position of the post member of FIGS. 17–20 and drawn to an enlarged scale, the slide element shown in the locked position in full line;

FIG. 22 is a fragmentary, schematic view of the pedestal portion and slide element of FIG. 21;

FIG. 23 is a perspective view of still another embodiment of the hinge of the present invention utilizing a key locking mechanism for the staple member, and with the latch arm in the open position;

FIG. 24 is a plan view of this embodiment with the leaf pivoted into the closed position;

FIG. 25 is a side elevational view thereof;

FIG. 26 is a fragmentary perspective view of this embodiment with the post member pivoted 90° into the latching position;

DETAILED DESCRIPTION OF THE ILLUSTRATED EMBODIMENTS

Figure 1:
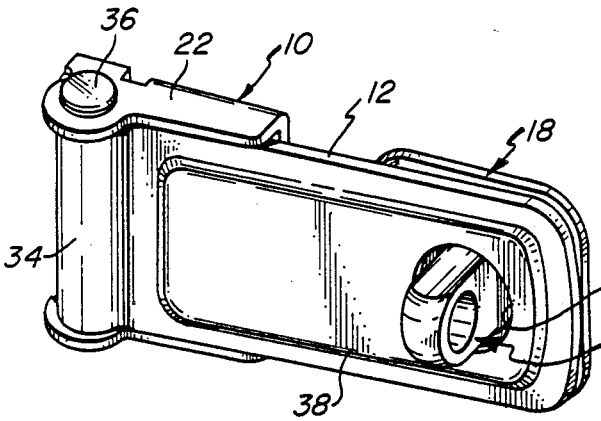
FIG. 1 is a perspective view of a hasp-type latch constructed in accordance with the present invention and with the latch arm in the closed position.
Figure 2:
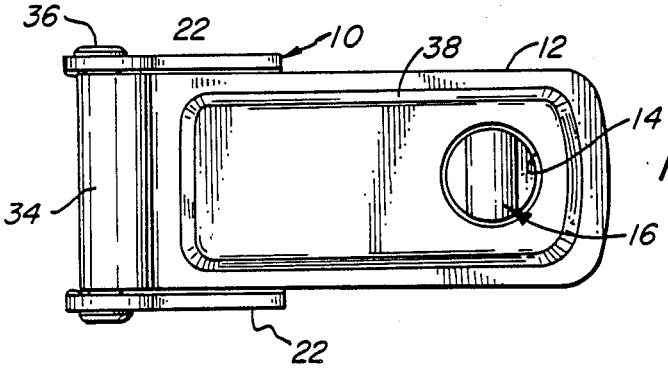
FIG. 2 is a plan view thereof.
Figure 3:
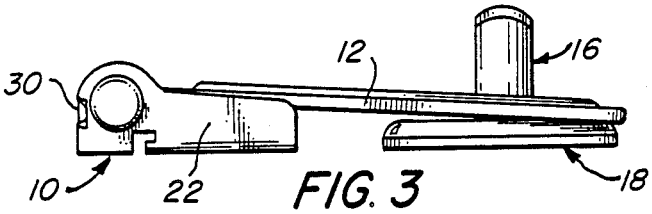
FIG. 3 is a side elevational view thereof.
Figure 4:
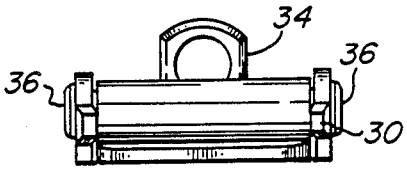
FIG. 4 is an end elevational view of the barrel end of the latch.
Figure 5:
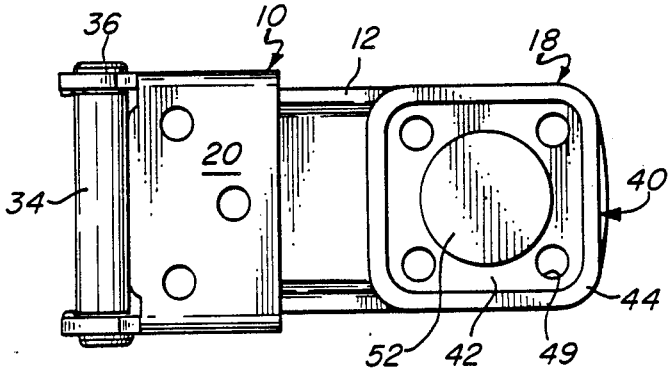
FIG. 5 is a bottom view thereof.
Figure 6:
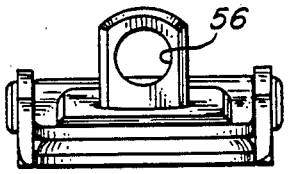
FIG. 6 is an end elevational view of the staple end of the latch.
Figure 7:
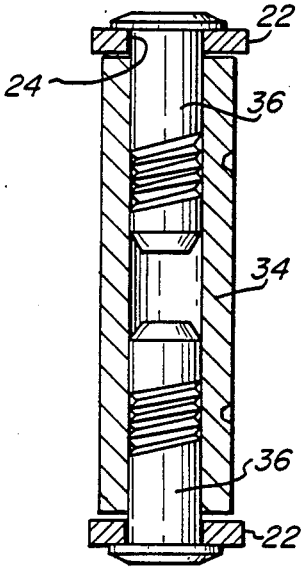
FIG. 7 is a sectional view through the barrel of the hasp member and drawn to an enlarged scale.

Turning first to the embodiment of FIGS. 1–11, the latch is comprised of the hasp member generally designated by the numeral 10 having an elongated latch arm 12 with an aperture 14 adjacent its free end through which extends the post member generally designated by the numeral 16 of the staple member generally designated by the numeral 18.

The hasp member 10 has a base wall 20 and upstanding side walls 22 extending along its side margins parallel to the arm 12. At one end, the side walls 22 are of greater height and have apertures 24 formed therein. The base wall 20 is truncated or terminated adjacent the enlarged portion of the side walls 22, and it is provided with a multiplicity of mounting apertures 26 extending therethrough for screws (not shown) to mount it upon the mounting surface (not shown).

Figure 8:
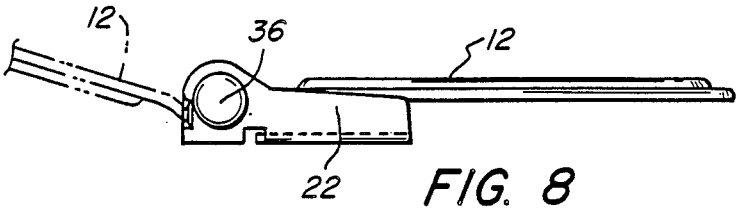
FIG. 8 is side elevational view of the hasp member showing the latch arm in the closed position in full line and fragmentarily in the open position in phantom line.
Figure 9:
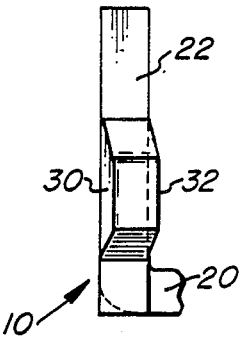
FIG. 9 is a fragmentary end elevational view of one sidewall of the base of the hasp member and drawn to an enlarged scale.
Figure 10:
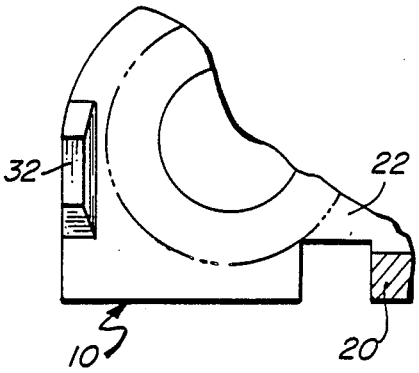
FIG. 10 is a fragmentary elevational view in partial longitudinal section looking at one sidewall portion of the hasp member with the latch arm removed.

The enlarged portions of the side walls 22 have staked portions 30 at their outer edges spaced upwardly from the plane of the base wall 20, and these provide inwardly extending, opposed detents 32 which will frictionally engage the arm 12 when it is pivoted into the open position shown in phantom line in FIG. 8. This allows the user to secure the arm 12 in a non-interfering position.

The leaf 12 has its one end rolled to form a generally cylindrical barrel 34, and a pair of hinge pins 36 extend through the apertures 24 in the side walls 22 and into the barrel 34 to pivotally mount it in the side walls 22.

The arm 12 is stamped to provide an elongated, raised platform portion 38 which extends from adjacent the barrel 34 to adjacent its free end and provides both enhanced strength and improved appearance. In this embodiment, the aperture 14 in the arm 12 is circular.

Turning now to the staple member 18, it has a pad 40 with a top wall 42 and a depending sidewall 44 extending thereabout to define a cavity 46 therewithin. In the top wall 42 is an opening 48 through which the post member 16 extends. The top wall 42 also has mounting apertures 49 to seat screws (not shown) to secure the pad 40 to the mounting surface 28.

Figure 11:
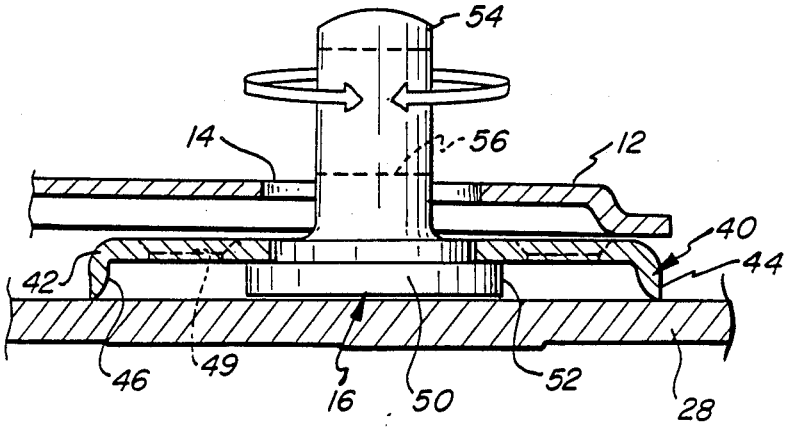
FIG. 11 is a fragmentary sectional view of the latch at the staple end drawn to an enlarged scale, and showing it mounted upon a fragmentarily illustrated support surface and diagrammatically illustrating the rotation of the post member.

As seen in FIG. 11 the post member 16 has a pedestal portion 50 which extends downwardly through the opening 48 and has an enlarged collar section 52 of greater dimension than the opening 48 to prevent its being pulled upwardly therethrough. The post member 16 also has an upwardly extending post portion 54 with a passage 56 extending transversely therethrough and adapted to receive the shackle of a lock (not shown). In this embodiment, the post member 16 is maintained in assembly with the pad 40 by having its collar section 52 trapped in the cavity 46 between the top wall 42 and the mounting surface 28.

Moreover, the post portion 54 is dimensioned and configured to freely rotate within the aperture 14 in the arm 12, and the arm 12 will be secured in the closed position by an element (not shown) extending through the passage 56 and over the surface of the arm 12 to preclude its pivoting thereby.

Turning now to FIGS. 12–16, therein illustrated is another embodiment of staple member **18*a* having a post member 16*a* with a post portion 54*a* having a greater longitudinal dimension than that of FIGS. 1–10 and a neck section 66 of lesser dimension but overlying the margins of the opening 48*a* in the top wall 42*a*. This provides latching action without requiring a lock or other element inserted in the passage 56, because the aperture 14*a* on the arm 12*a* is elongated along the longitudinal axis of the arm 12*a* as seen in FIG. 12, but is of lesser width than the length of the upper or head section of the post portion 54*a*. As a result, when the post member 16*a* is rotated 90° from the position seen in FIG. 13, to that seen in FIG. 15, the upper section of the post portion 54*a* will overlie portions of the arm 12*a* about the aperture 14*a*** to retain it in the closed position.

As seen in FIG. 16, the post member **16*a* has a pedestal portion 50*a* extending into the cavity 46*a*. The foot 60 of the pedestal portion 50*a* seats a conventional flat washer 62, and a spring member 63 such as a spring washer is compressed between the washer 62 and the top wall 42*a* to provide resistance to rotation of the post member 16*a***.

In FIGS. 17–21, there is illustrated another embodiment of staple member **18*b* utilizing a combination lock 70 as a part of the post member 16*b* which has a cylindrical portion 72 and a laterally projecting upper portion 74 extending above the arm 12*b*, as best seen in FIG. 19. The aperture 14*b* in the arm 12*b* is cooperatively dimensioned and configured to pivot downwardly over the post member 16*b*** in the unlocked position.

As seen in FIG. 21, the pedestal portion 76 extends into the cavity **46*b* and the post member 18*b* has a slide element generally designated by the numeral 78 slidably seated in a slot 80 along one side thereof with a finger portion 82 projecting outwardly of the slot 80 for finger actuation and a pair of toes 84 on the bifurcated foot portion 86. The outer portion of the slide element 78 is configured to be above the plane of the arm 12*b* in its closed position so as not to interfere with latching and unlatching action, and the foot portion 86 slides on the washer 88**.

The slide element 78 is biased outwardly by springs 90 as seen in FIG. 22 and is retained in assembly by the capture of its lower portion in the slot 80 and inside the opening **48*b* of the pad 40*b*. The washer 88, combination lock 70 and its cam rings 92 are held in assembly by the pin 94, and the staple member 18*b* is secured in assembly on the pad 40*b* by the lock ring 96**.

In accordance with conventional construction, the several cam rings 92 of the combination lock 70 may be rotated to bring them into the proper position determined by the present combination. In this latch, they have a series of notches (not shown) in their periphery which are then aligned with a vertically extending shoulder on the slide element 78. At this point, the slide element 78 may be pushed inwardly against the pressure of the springs 90 to move the slide element 78 from the notch 98 in the top wall **42*b*, thus allowing rotation of the post member 16*b* into the unlatched position seen in FIGS. 17–19**.

In operation of this embodiment, the arm **12*b* is pivoted over the post member 16*b* while it is oriented in the position seen in FIG. 17. Thereafter, the post member 16*b* is rotated 180° to the position seen in FIGS. 20 and 21, at which time the springs 90 bias the slide element 78 outwardly into the notch 98 in the top wall 42*b*. Rotating the combination lock knob 70 will now displace the cam rings 92 to preclude the slide element 78 from being pushed to disengage it from the slot 98. When it is desired to unlock the latch, the combination lock 70 is rotated to align the slots in the cam rings 92 with the slide element 78 so that it may be pressed inwardly to unseat it from the notch 98 and allow rotation of the post member 16*b***.

Turning lastly to the embodiment of FIGS. 23–31, the staple member **18*c* utilizes a key lock mechanism 100 as a part of the post member 16*c*. The post portion 54*c* is elongated and rotatable upon the pad 40*c* from the position in FIG. 23 to the position seen in FIG. 26 to latch the arm 12*c* on the staple member 18*c***.

Figure 27:
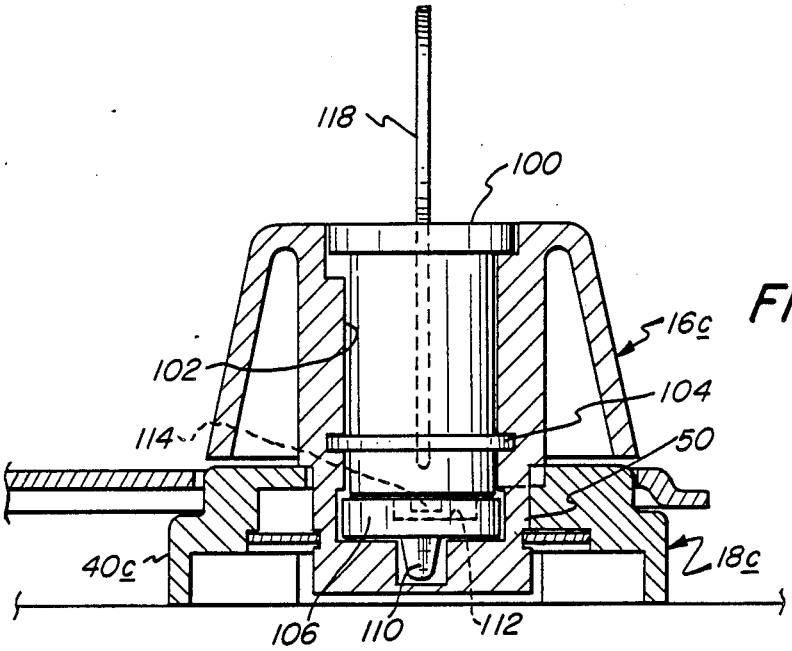
FIG. 27 is a fragmentary sectional view drawn to an enlarged scale of the staple end of the hinge assembly of this embodiment, and showing a key inserted into the key lock.
Figure 29:
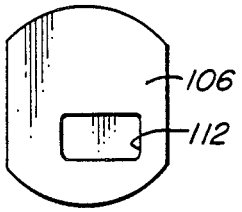
FIG. 29 is a plan view of the lock plate in this assembly.
Figure 28:
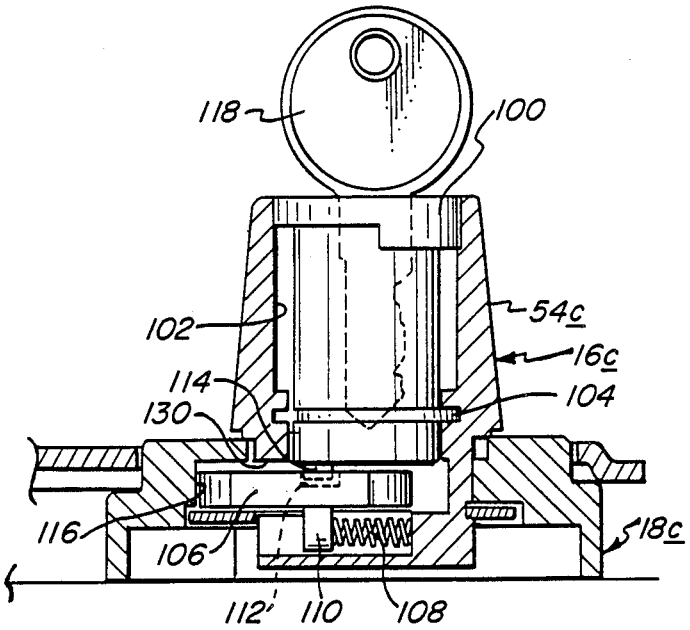
FIG. 28 is a similar view with the post member rotated 90° from the position shown in FIG. 27 to effect locking.
Figure 30:
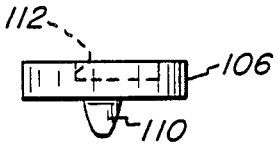
FIG. 30 is a side elevational view of the lock plate.

As seen in FIGS. 27 and 28, the key lock mechanism or cylinder 100 is seated in a recess 102 in the post member **16*c* and is held therein by the split ring 104. The pedestal portion 50*c* has a slot 104 in one side thereof extending into the base of the recess 102, and slidably seated therein is the lock plate 106 which is biased outwardly thereof by the spring 108 acting upon a depending boss 110 thereon. In its top surface is a recess 112 which seats a dog 114 on the lock cylinder 100. When the post member 16c is rotated from the unlatching position seen in FIGS. 23 and 25 to the latching position seen in FIGS. 26 and 28 and the lock cylinder 100 is rotated, the lock plate 106 is rotated into the lock position wherein the spring 108 biases the lock plate 106 outwardly into a recess 116 in the pad 40c**.

To release the lock plate, the lock cylinder 100 must be rotated by the action of the key 118 to rotate the lock plate 106, and move it inwardly of the slot 104, thus disengaging it from the recess 116. Then, the post member 16c may be rotated to the unlatching position.

Figure 31A:
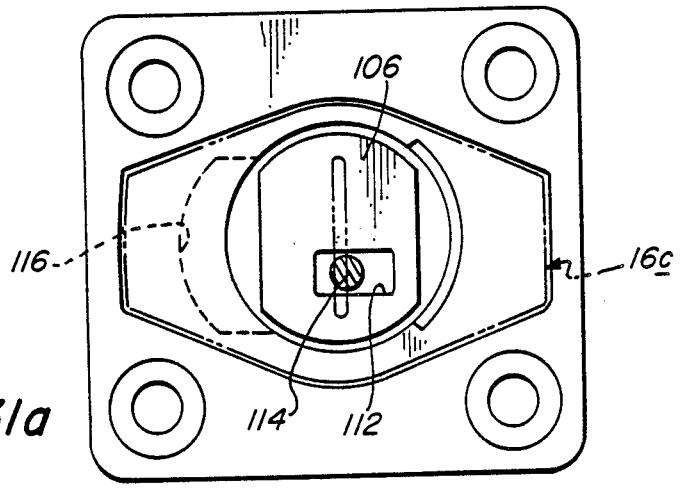
FIGS. 31*a–c* are diagrammatic views showing the movement of the locking dog and lock plate as the post member and key are rotated.
Figure 31B:
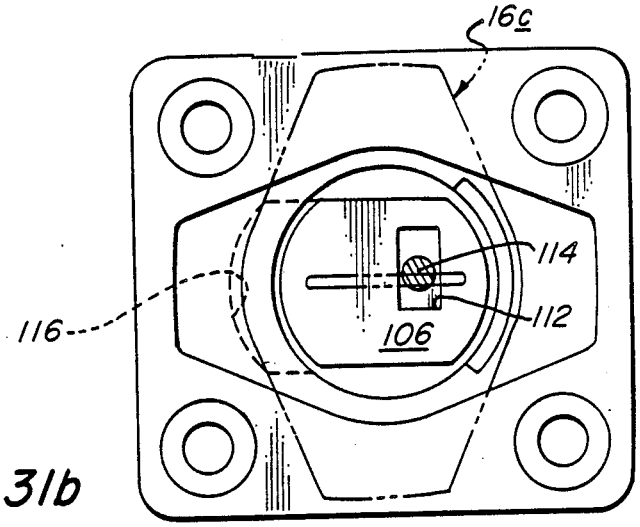
Figure 31C:
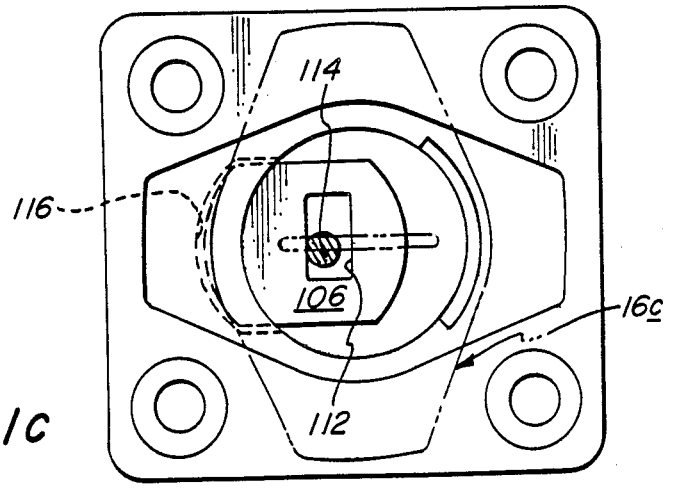

The several steps in the motion of the lock plate 106 from the initial unlatching position are shown diagrammatically in FIG. 31*a–c*.

In FIG. 31*a*, the post member 16c is in the unilateral position and the dog 114 is seated in the recess 112 of the lock plate 106.

In FIG. 31*b*, the post member 16c has been rotated 90° to the latch position which has rotated the lock plate 106 through 90°. As yet, the lock plate 106 is restrained from movement into the recess 116 by the dog 114.

In FIG. 31*c*, the lock cylinder 100 has been rotated 180° from the position in FIG. 31*b* and the plate 106 has now been biased outwardly into the recess 116 to lock the post member against rotation.

Thus, it can be seen that the hasp-type latches of the present invention may be readily fabricated and at relatively low cost. Those which employ integral locks may use commercially available components. The resultant structure is attractive, durable and relatively secure.

Having thus described the invention, what is claimed is:

1. A hasp-type latch comprising:

(a) a hasp-type member having:

(i) a pad with a base wall and a pair of upstanding walls extending along its side margins, said base wall being adapted to be mounted on a support surface;

(ii) an elongated leaf having one end portion disposed between said upstanding walls, said one end portion terminating in a generally cylindrical barrel portion, said leaf having an aperture therethrough adjacent its other end;

(iii) hinge pin means seated in said upstanding walls adjacent one end thereof and extending into said barrel portion to pivotally mounted said leaf on said pad for movement from a locking position wherein its opposite end portion extends beyond the margins of said pad spaced from said hinge pin means and an open position in which said other end portion extends in the opposite direction, said pad having means in said upstanding walls adjacent said one end releasably engageable with said leaf only in its open position to hold it in said position; and (b) a staple member having:

(i) a base with a top wall and a depending sidewall defining a cavity thereunder, said top wall having an opening therethrough; and (ii) a post member with a pedestal portion extending through said opening into said cavity and a post portion extending above said top wall and through said aperture in said leaf in said closed position thereof, said pedestal portion having securing means thereon in said cavity extending beyond said opening to prevent its being pulled through said opening in said top wall.

2. The latch in accordance with claim 1 wherein said post portion is rotatable on said base.

3. The latch in accordance with claim 2 wherein detents are provided on an enlarged portion of said sidewalls adjacent on end of said pad to provide said releasably engageable means and said hinge pin means is seated in said enlarged portion of said sidewalls.

4. The latch in accordance with claim 3 wherein said base wall of said pad is truncated at a point spaced from said one end.

5. The latch in accordance with claim 1 wherein said releasably engageable means on said pad comprises detents frictionally engaging said leaf.

6. The latch in accordance with claim 1 wherein said aperture in said leaf is elongated in the longitudinal dimension of said leaf and wherein said post portion is rotatable on said base and is elongated, said post portion being dimensioned and configured to extend through said aperture in said leaf in a first position wherein its elongate axis extends parallel to that of said leaf and to overlie a portion of said leaf about said aperture when rotated 90° into a second position, said pedestal portion having a section adjacent said post portion of a width less than the minimum dimension of said aperture in said leaf and extending through said aperture in the closed position of said leaf.

7. The latch in accordance with claim 6 wherein said post member includes a locking assembly with manipulatable lock means and latch means engageable with said base member to prevent rotation of said post portion from its second position to said first position, said latch means being releasable by said manipulatable lock means.

8. The latch in accordance with claim 7 wherein said manipulatable lock means is a key lock.

9. The latch in accordance with claim 8 wherein an extensible element on said post portion is engageable in a recess to effect said prevention of rotation.

10. The latch in accordance with claim 1 wherein said post portion has a passage extending therethrough to receive the shackle of a lock or the like.

11. The latch in accordance with claim 1 wherein said post member is integrally formed with a pedestal portion having a section within said cavity of said base of greater dimension than said opening and a post portion projecting outwardly therefrom.

12. The latch in accordance with claim 1 wherein said enlarged section of said pedestal portion is provided by a locking element engaged on the body of said pedestal portion.

13. The latch in accordance with claim 12 wherein said post member additionally includes resiliently compressible means disposed between said locking element and the adjacent surface of said top wall of said base to provide resistance to rotation of said post portion.

14. The latch in accordance with claim 1 wherein said post member is comprised of a locking assembly including manipulatable lock means and latch means actuatable thereby and engageable with said base to prevent rotation of said post member and thereby of said leaf pivoting outwardly from said post.

15. The latch in accordance with claim 14 wherein said locking assembly latch means comprises a dog movable to engage in a recess to prevent rotation of said post portion, said dog being movable upon operation of said lock means.

16. The latch in accordance with claim 15 wherein said lock means is a combination lock.

17. In the method for making a hasp-type latch, the steps comprising:

(a) forming a sheet metal workpiece to provide a generally U-shaped pad with a base wall adapted to be mounted on a support surface and a pair of upstanding side walls having aligned apertures adjacent one end thereof;

(b) providing releasably engageable means on said side walls adjacent the edges of said one end and spaced outwardly from said base wall and spaced towards said edges from said apertures;

(c) forming on elongated sheet metal workpiece into a hinge leaf with a rolled barrel of generally cylindrical configuration at one end and an aperture extending therethrough adjacent its other end;

(d) assembling said leaf to said pad with said barrel aligned with said apertures in said sidewalls;

(e) seating hinge pin means in said apertures and barrel, said hinge leaf being movable on said pad from a locking position wherein its opposite end portion extends beyond the margins of said pad spaced from said hinge pin means and an open position in which said outer end portion extends in the opposite direction, said pad having means in said upstanding walls adjacent said one end releasably engageable with said leaf only in its open position to hold it in said position;

(f) forming a sheet metal workpiece to provide a rectangular box-like base with a top planar wall and a sidewall extending thereabout to define a cavity and to provide an opening in said top wall; and (g) assembling to said base a post member having a pedestal portion extending through said opening into said cavity and a post portion extending upwardly from said top wall and dimensioned and configured to extend through said aperture in said leaf.

18. The method of forming a hasp-type latch in accordance with claim 17 wherein said step of forming the sheet metal workpiece into said pad includes removing of metal from the workpiece so as to terminate said base wall adjacent said barrel.

19. The method of forming a hasp-type latch in accordance with claim 17 wherein said step of providing said engageable means on said side walls of said pad comprises staking inwardly edge portions of said side walls to provide detents for frictionally engaging the edges of said leaf.

20. The method for forming a hasp-type latch in accordance with claim 17 wherein said post member comprises in part a combination lock with an extensible portion engageable with said base upon rotation of said post member to a locking position thereof and movable to effect disengagement thereof upon rotation to the proper combination.

21. The method for forming a hasp-type latch in accordance with claim 17 wherein said post member comprises in part a key lock with a projecting portion engageable with said- base in a locking position thereof upon rotation of said post member and said key look to a looking position and disengageable therefrom upon unlocking of said key lock to permit rotation of said post member to an unlatching position.

* * * * *

UNITED STATES PATENT AND TRADEMARK OFFICE

CERTIFICATE OF CORRECTION

PATENT NO. : 4,793,163

DATED : December 27, 1988

INVENTOR(S) : Walter J. MacFarlane et al

It is certified that error appears in the above-identified patent and that said Letters Patent is hereby corrected as shown below:

Column 7, line 50, "mounted" should be -- mount --;

Column 8, line 8, "on" should be -- one --.

Column 9, line 28, "outer" should be -- other --.

Column 10, line 31, "look" should be -- lock --;
line 32, "looking" should be -- locking --.

Signed and Sealed this

Twenty-second Day of August, 1989

*Attest:*

*Attesting Officer*

DONALD J. QUIGG

*Commissioner of Patents and Trademarks*